US009883713B2

(12) United States Patent
Kawakami

(10) Patent No.: US 9,883,713 B2
(45) Date of Patent: Feb. 6, 2018

(54) FOOTWEAR

(71) Applicant: Akiko Kawakami, Tokyo (JP)

(72) Inventor: Akiko Kawakami, Tokyo (JP)

(73) Assignee: Wedge.cool, Ltd., Chuo-ku, Tokyo (JP)

( * ) Notice: Subject to any disclaimer, the term of this patent is extended or adjusted under 35 U.S.C. 154(b) by 0 days.

(21) Appl. No.: 15/219,298

(22) Filed: Jul. 26, 2016

(65) Prior Publication Data

US 2016/0331064 A1 Nov. 17, 2016

Related U.S. Application Data

(63) Continuation of application No. PCT/JP2015/052598, filed on Jan. 29, 2015.

(30) Foreign Application Priority Data

Feb. 1, 2014 (JP) ..... 2014-018112
Nov. 27, 2014 (JP) ..... 2014-239401

(51) Int. Cl.
*A43B 3/24* (2006.01)
*A43B 3/10* (2006.01)
(Continued)

(52) U.S. Cl.
CPC ..... *A43B 3/244* (2013.01); *A43B 1/0063* (2013.01); *A43B 3/10* (2013.01); *A43B 3/103* (2013.01);
(Continued)

(58) Field of Classification Search
CPC ..... A43B 3/24; A43B 3/242; A43B 3/244
(Continued)

(56) References Cited

U.S. PATENT DOCUMENTS 2,367,232 A * 1/1945 Marx ..... A43B 3/24 36/101
2,651,117 A * 9/1953 Harris ..... A43B 3/28 36/11.5
(Continued)

FOREIGN PATENT DOCUMENTS

CN 2122508 U 11/1992
CN 202127891 U 2/2012
(Continued)

OTHER PUBLICATIONS

International Search Report for PCT/JP2015/052598 dated May 19, 2015.
PCT written opinion dated May 19, 2015.

*Primary Examiner* — Marie Bays
(74) *Attorney, Agent, or Firm* — Yokoi & Co., U.S.A.; Toshiyuki Yokoi

(57) ABSTRACT

An upper portion of a footwear is detachably attached, the attached upper portion is sufficiently prevented from being removed, and the footwear can be thinner. To attach an upper portion (5) on an outsole portion (3), a plurality of insertion pieces (15) made of a material having elasticity is formed on a periphery of the upper portion (5). A locking hole (19) is formed on each of the insertion pieces (15). Insertion holes (21) are formed on the outsole portion (3) at a position of each of the insertion pieces (15) in a state that the upper portion (5) is attached so that the insertion pieces (15) is inserted into and penetrated through the insertion holes (21). Locking protrusions (31) are formed on the outsole portion (3) to lock the locking hole (19) in this state.

12 Claims, 10 Drawing Sheets

(51) Int. Cl.

| | |
|---|---|
| ***A43B 3/12*** | (2006.01) |
| ***A43B 1/00*** | (2006.01) |
| ***A43B 13/14*** | (2006.01) |
| ***A43B 23/02*** | (2006.01) |

(52) U.S. Cl.
CPC ..... *A43B 3/12* (2013.01); *A43B 3/128* (2013.01); *A43B 3/24* (2013.01); *A43B 13/14* (2013.01); *A43B 23/0245* (2013.01)

(58) Field of Classification Search
USPC ..... 36/15, 100, 101
See application file for complete search history.

(56) References Cited

U.S. PATENT DOCUMENTS 3,890,725 A * 6/1975 Lea ..... A43B 3/24 36/11.5
3,902,259 A * 9/1975 Cracco ..... A43B 3/103 36/101
4,839,948 A * 6/1989 Boros ..... A43B 1/0054 24/303
5,339,543 A * 8/1994 Lin ..... A43B 3/24 36/100
6,442,870 B1 * 9/2002 Tsai ..... A43B 3/103 36/100
6,931,766 B2 * 8/2005 Greene ..... A43B 3/122 36/100
7,117,615 B2 * 10/2006 Gerber ..... A43B 3/103 36/101
8,307,570 B2 * 11/2012 Delgatty ..... A43B 1/0027 36/100
2005/0097781 A1 * 5/2005 Greene ..... A43B 3/122 36/101
2005/0262738 A1 * 12/2005 Gerber ..... A43B 3/103 36/101
2010/0024251 A1 * 2/2010 Delgatty ..... A43B 1/0027 36/101

FOREIGN PATENT DOCUMENTS

| | | | |
|---|---|---|---|
| JP | S10-10524 | Y | 7/1935 |
| JP | S10-12079 | Y | 8/1935 |
| JP | S17-3031 | Y | 3/1942 |
| JP | S28-4340 | Y | 5/1953 |
| JP | S36-18245 | Y | 7/1961 |
| JP | S56-5921 | Y | 2/1981 |
| JP | H06-33502 | U | 5/1994 |
| JP | 3083693 | U | 2/2002 |

* cited by examiner

Fig. 3F1
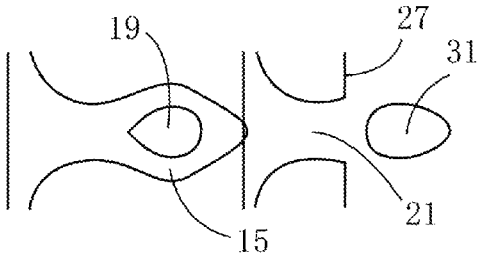
Fig. 3D1
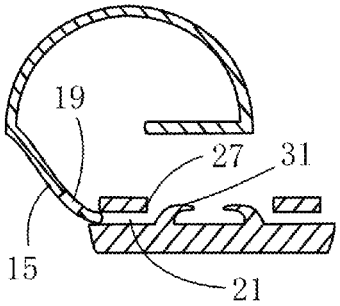
Fig. 3F2
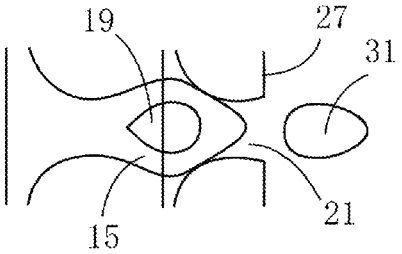
Fig. 3D2
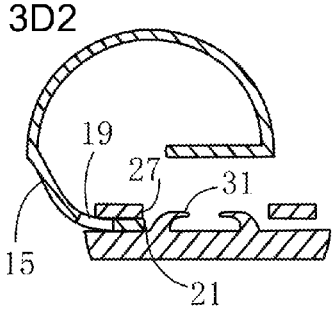
Fig. 3F3
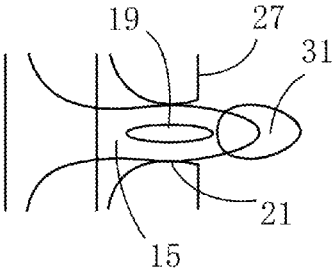
Fig. 3D3
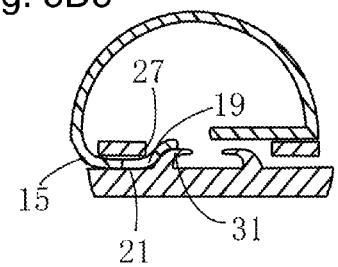
Fig. 3F4
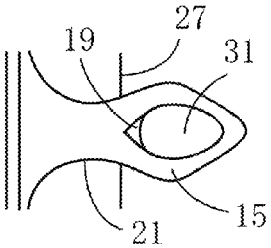
Fig. 3D4
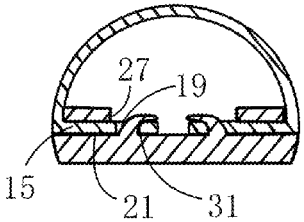

Fig. 4A
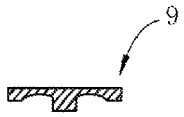
Fig. 4B
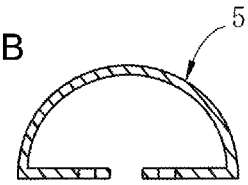
Fig. 4E
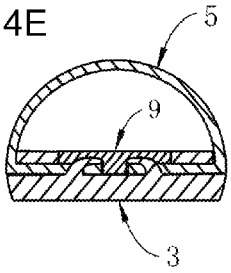
Fig. 4C
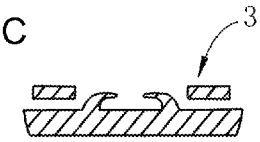
Fig. 4D1a
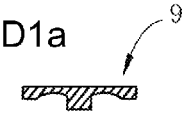
Fig. 4D2a
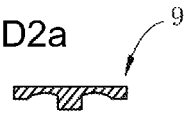
Fig. 4D3b
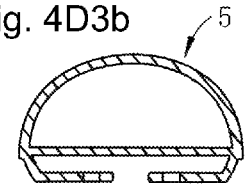
Fig. 4D1b
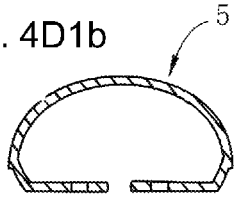
Fig. 4D2b
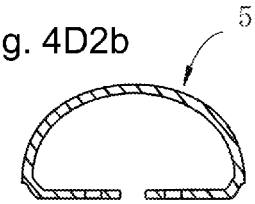
Fig. 4D3c
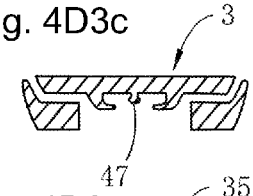
Fig. 4D1c
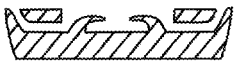
Fig. 4D2c
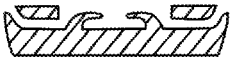
Fig. 4D3a
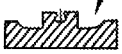
Fig. 4D1e
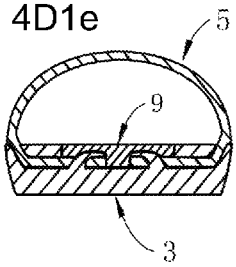
Fig. 4D2e
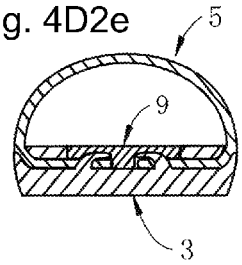
Fig. 4D3e
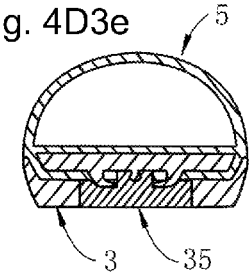

Fig. 6A
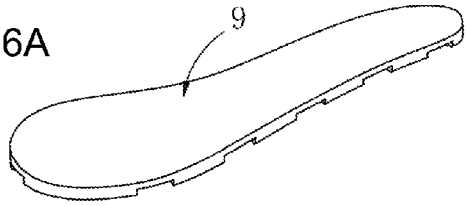
Fig. 6A'
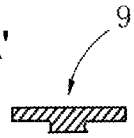
Fig. 6B
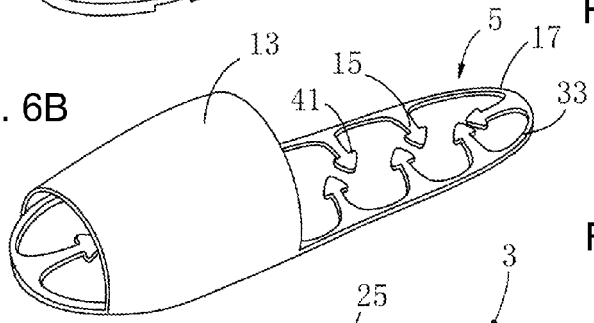
Fig. 6B'
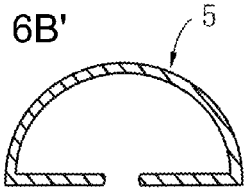
Fig. 6C
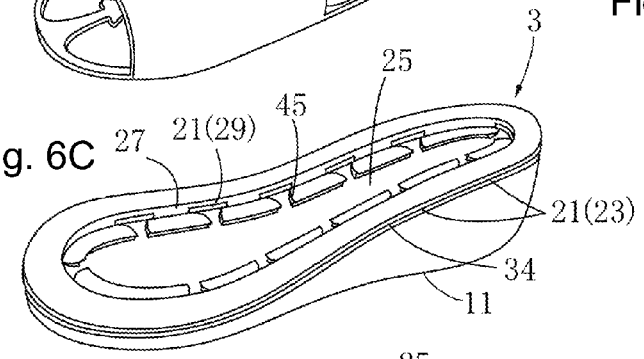
Fig. 6C'
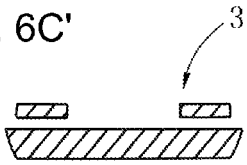
Fig. 6E'
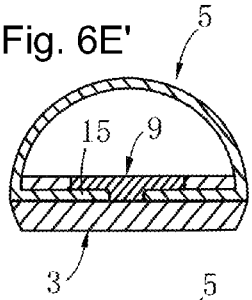
Fig. 6D
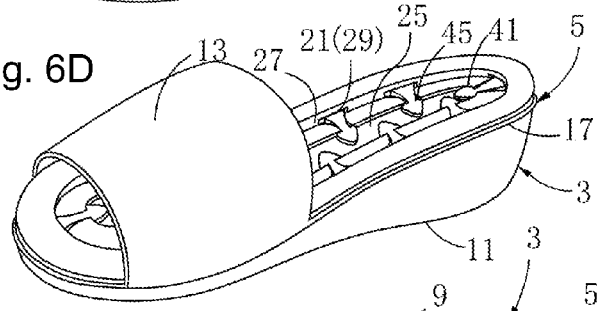
Fig. 6E"
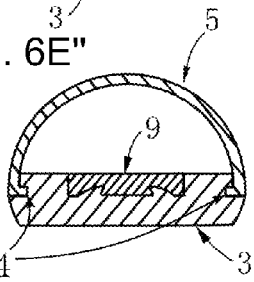
Fig. 6E
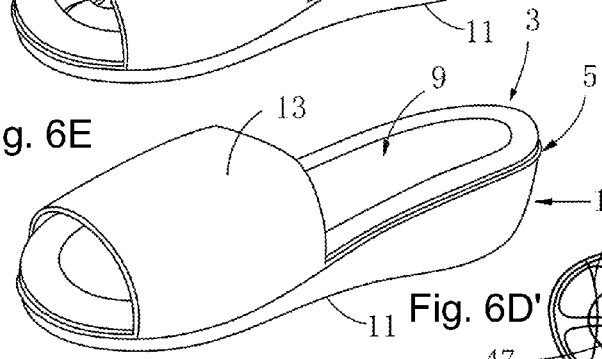
Fig. 6D'
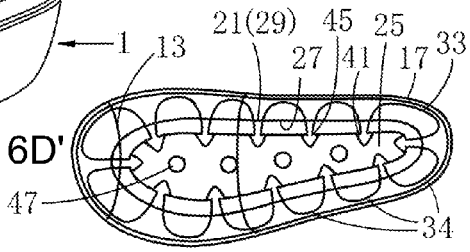

Fig. 7A
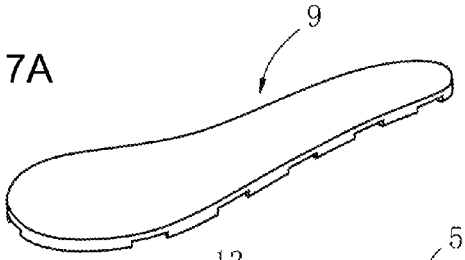
Fig. 7A'
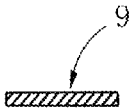
Fig. 7B
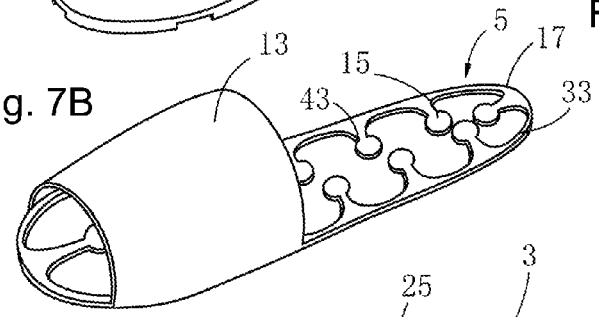
Fig. 7B'
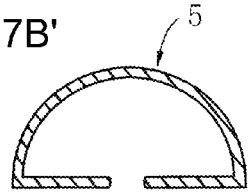
Fig. 7C
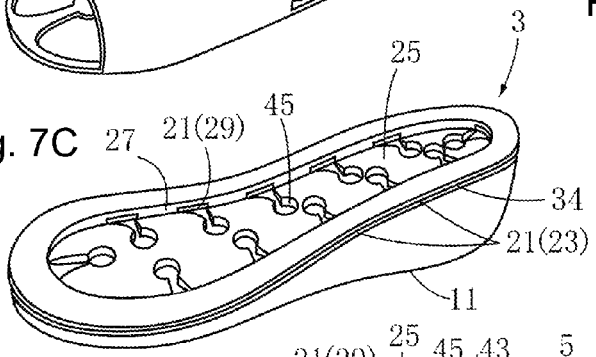
Fig. 7C'
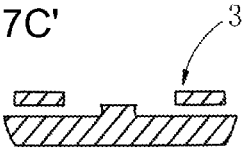
Fig. 7D
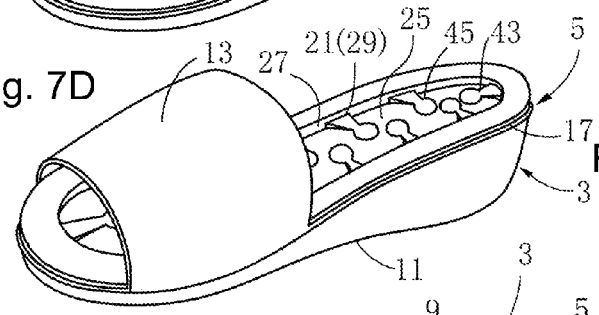
Fig. 7E'
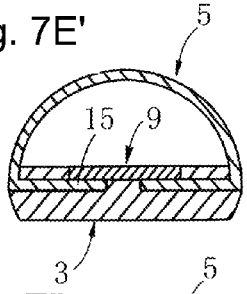
Fig. 7E"
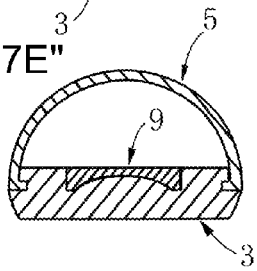
Fig. 7E
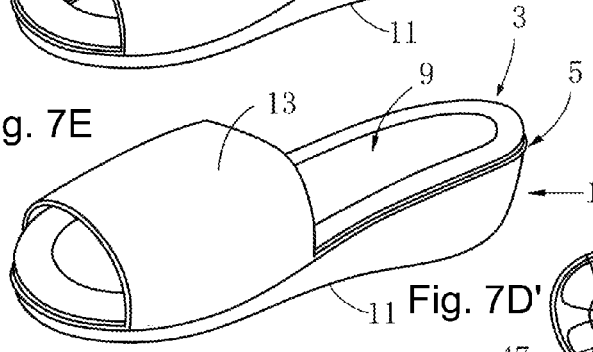
Fig. 7D'
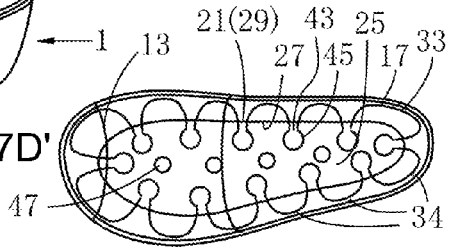

Fig. 8F1
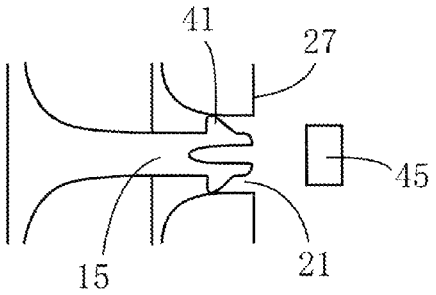
Fig. 8D1
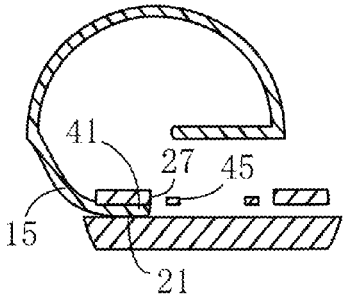
Fig. 8F2
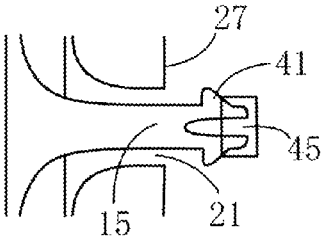
Fig. 8D2
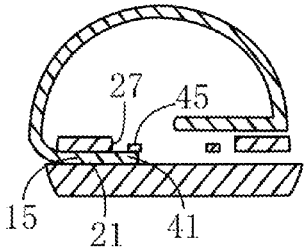
Fig. 8F3
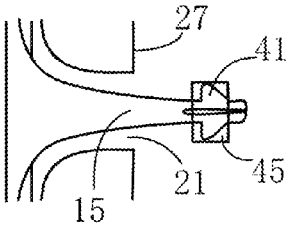
Fig. 8D3
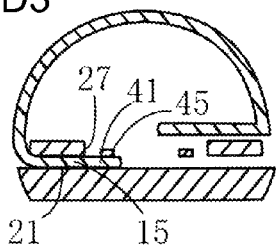
Fig. 8F4
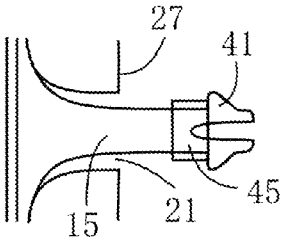
Fig. 8D4
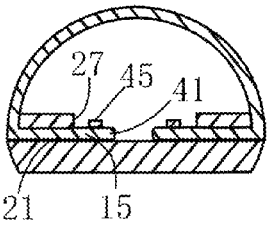

Fig. 9G
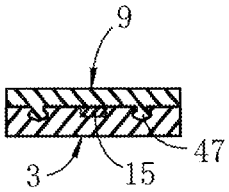
Fig. 9G'
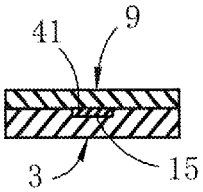
Fig. 9E
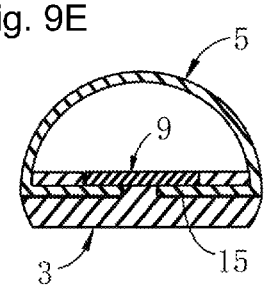
Fig. 9H
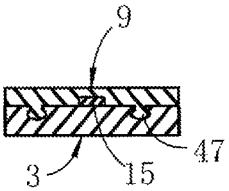
Fig. 9H'
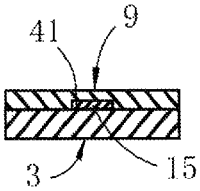
Fig. 9E'
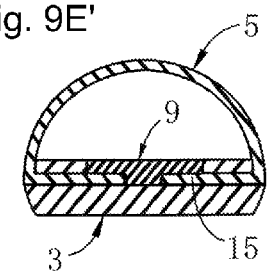
Fig. 9I
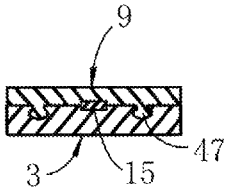
Fig. 9I'
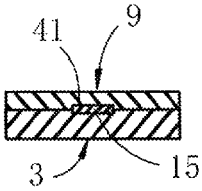
Fig. 9E"
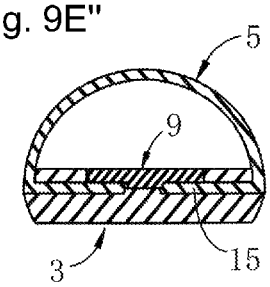

Fig. 10A
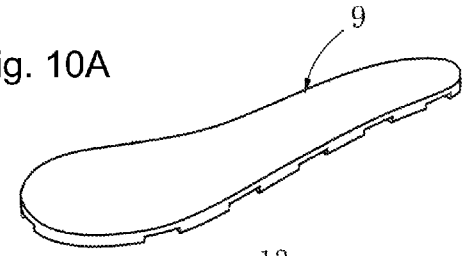
Fig. 10B
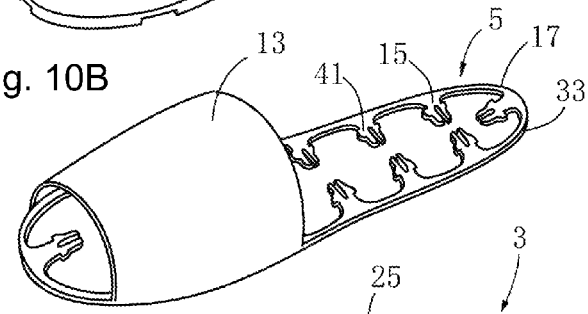
Fig. 10C
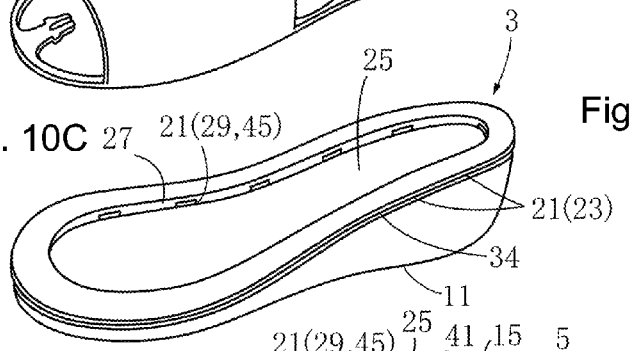
Fig. 10D
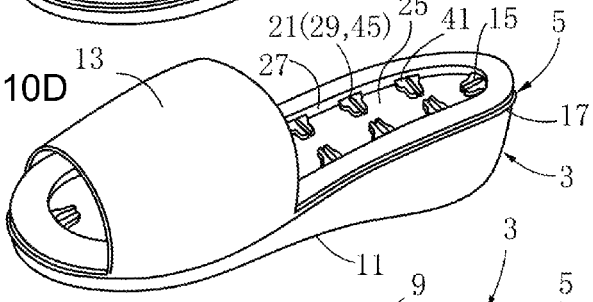
Fig. 10E
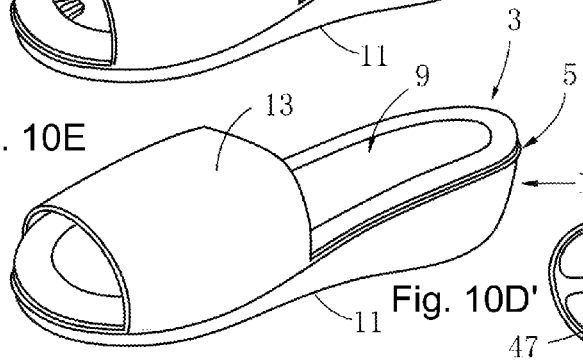
Fig. 10F1
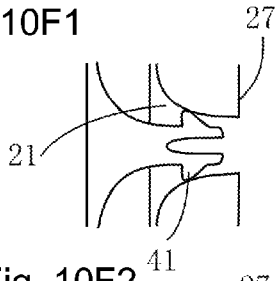
Fig. 10F2
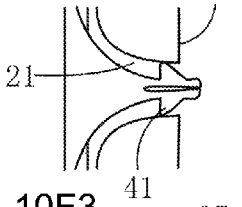
Fig. 10F3
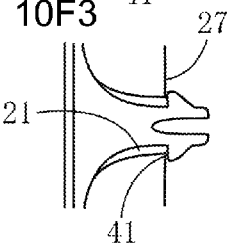
Fig. 10E'
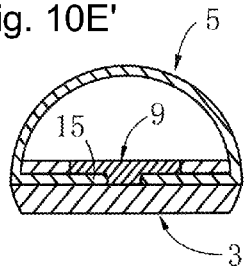
Fig. 10D'
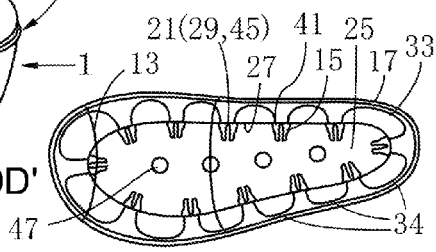

FOOTWEAR

CROSS-REFERENCES TO RELATED APPLICATIONS

This application claims the benefit of priority and is a Continuation application of the prior International Patent Application No. PCT/JP2015/052598, with an international filing date of Jan. 29, 2015, which designated the United States, and is related to the Japanese Patent Application No. 2014-018112 filed Feb. 1, 2014, and Japanese Patent Application No. 2014-239401 filed Nov. 27, 2014, the entire disclosures of all applications are expressly incorporated by reference in their entirety herein.

BACKGROUND OF THE INVENTION

1. Field of the Invention

The present invention relates to a footwear formed by an outsole portion and an upper portion. In particular, the present invention relates to attachable/detachable structure of the upper portion.

2. Description of Related Art

In Patent Document 1 below, a mechanism of detachably attaching a strap portion (40) to form an upper portion of a sandal is disclosed. In this mechanism, a projected locking portion (20) formed on an outsole (10) is inserted into holes formed on both ends of the strap portion (40). The strap portion (40) is prevented from being detached by stopper claws (21 or 25A) formed on the locking portion (20).

Patent document 1: Japanese utility model registration No. 3083693

BRIEF SUMMARY OF THE INVENTION

However, only the stopper claws (21 or 25A) disclosed in Patent Document 1 are not strong enough for preventing the detachment. In addition, when inserting the strap portion (40), both ends of the strap portion (40) should be moved downward toward the locking portion (20) formed on the outsole (10). Because of this, a large space is needed on the outsole (10) in a vertical direction. Thus, the mechanism could not be applied to a footwear having a small thickness.

The present invention provides a footwear capable of sufficiently preventing the detachably attached upper portion from being detached although the thickness of the footwear can be kept smaller.

One embodiment of the present invention provides a footwear, comprising:

an outsole portion having a portion to be in contact with the ground; and an upper portion having a portion crossing over instep of foot, the upper portion being attachable to and detachable from the outsole portion; wherein a plurality of insertion pieces made of a material having elasticity is formed on a periphery of the upper portion, a recess is formed on a center of an upper surface of the outsole portion, insertion holes are formed on the outsole portion, the insertion holes being directed from an outer periphery of the outsole portion to the recess located at the center, a groove is formed between each of the insertion holes so that a joint portion connecting each of the insertion pieces is fitted into the groove when the upper portion is attached to the outsole portion, the groove being directed from the outer periphery to an inner side of the outsole portion, and the upper portion is attachable to the outsole portion by inserting the insertion pieces into the insertion holes in a direction toward the recess located at the center.

In another embodiment of the present invention, a locking hole is formed on each of the insertion pieces, and locking protrusions are formed at a bottom of the recess formed on the center of the upper surface of the outsole portion, the locking protrusions being located at a position enabling to lock the locking hole in a state that each of the insertion pieces is penetrated through into the insertion holes.

In another embodiment of the present invention, an insole portion attached to the upper surface of the outsole portion is further provided, wherein a locking hole is formed on each of the insertion pieces, a fitting hole is formed at a bottom of the recess formed on the center of the upper surface of the outsole portion, the fitting hole being located at a position to be overlapped with the locking hole in a state that each of the insertion pieces is penetrated through the insertion holes, and a fitting protrusion is formed on the insole portion, the fitting portion being located at a position enabling to pass through the locking hole and to fit with the fitting hole in a state that the upper portion and the insole portion are attached to the outsole portion.

In another embodiment of the present invention, a locking claw or a locking constriction is formed on a tip of each of the insertion pieces, and a lock receiving portion is formed at a bottom of the recess formed on the center of the upper surface of the outsole portion, the lock receiving portion being located at a position enabling to lock the locking claw or the locking constriction in a state that each of the insertion pieces is penetrated through the insertion holes.

In another embodiment of the present invention, an insole portion attached to the upper surface of the outsole portion is further provided, wherein a locking claw or a locking constriction is formed on a tip of each of the insertion pieces, and a lock receiving portion is formed on the insole portion, the lock receiving portion being located at a position enabling to lock the locking claw or the locking constriction in a state that the upper portion and the insole portion are attached to the outsole portion.

In another embodiment of the present invention, a locking claw is formed on a tip of each of the insertion pieces, and each of the insertion pieces has a shape to be contracted during when the insertion pieces are inserted into the insertion holes and to be expanded after penetrated through the insertion holes so that the insertion holes function as a lock receiving portion.

In another embodiment of the present invention, a dimension of each of the insertion holes is specified so that the insertion pieces can be inserted into the insertion holes after when the insertion pieces becomes smaller in width by being in contacted with the insertion holes and pushed by the insertion holes from both lateral ends of the insertion pieces to shrink the locking hole.

In another embodiment of the present invention, each of the insertion pieces is sharp-edged at a front end and tongue-shaped, and the locking hole is formed in a long shape longitudinally along a direction of inserting the insertion pieces.

In another embodiment of the present invention, each of the insertion pieces is sharp-edged at a front end and tongue-shaped, and the locking hole is sharp-edged at a front end and/or a rear end in a direction of inserting the insertion pieces.

In another embodiment of the present invention, each of the locking protrusions or the lock receiving portion is inclined upward in a slope shape toward a front side in a direction of inserting the insertion pieces.

In another embodiment of the present invention, the fitting protrusion and the fitting hole are formed in a locking shape.

Another embodiment of the present invention provides a footwear, comprising:

an outsole portion having a portion to be in contact with the ground; and an upper portion having a portion crossing over instep of foot, the upper portion being attachable to and detachable from the outsole portion; wherein a plurality of insertion pieces made of a material having elasticity is formed on a periphery of the upper portion, a recess is formed on a center of an lower surface of the outsole portion insertion holes are formed on the outsole portion, the insertion holes being directed from an outer periphery of the outsole portion to the recess located at the center, a groove is formed between each of the insertion holes so that a joint portion connecting each of the insertion pieces is fitted into the groove when the upper portion is attached to the outsole portion, the groove being directed from the outer periphery to an inner side of the outsole portion, and the upper portion is attachable to the outsole portion by inserting the insertion pieces into the insertion holes in a direction toward the recess located at the center.

In another embodiment of the present invention, a locking hole is formed on each of the insertion pieces, and locking protrusions are formed at a bottom of the recess formed on the center of the lower surface of the outsole portion, the locking protrusions being located at a position enabling to lock the locking hole in a state that each of the insertion pieces is penetrated through the insertion holes.

In another embodiment of the present invention, a back lid to be attached to the lower surface of the outsole portion is further provided, wherein a locking hole is formed on each of the insertion pieces, a fitting hole is formed at a bottom of the recess formed on the center of the lower surface of the outsole portion, the fitting hole being located at a position to be overlapped with the locking hole in a state that each of the insertion pieces is penetrated through the insertion holes, and a fitting protrusion is formed on the back lid, the fitting portion being located at a position enabling to pass through the locking hole and to fit with the fitting hole in a state that the upper portion and the back lid are attached to the outsole portion.

In another embodiment of the present invention, a locking claw or a locking constriction is formed on a tip of each of the insertion pieces, and a lock receiving portion is formed at a bottom of the recess formed on the center of the lower surface of the outsole portion, the lock receiving portion being located at a position enabling to lock the locking claw or the locking constriction in a state that each of the insertion pieces is penetrated through the insertion holes.

In another embodiment of the present invention, a back lid to be attached to the lower surface of the outsole portion is further provided, wherein a locking claw or a locking constriction is formed on a tip of each of the insertion pieces, and a lock receiving portion is formed on the back lid, the lock receiving portion being located at a position enabling to lock the locking claw or the locking constriction in a state that the upper portion and the back lid are attached to the outsole portion.

In another embodiment of the present invention, a locking claw is formed on a tip of each of the insertion pieces, and each of the insertion pieces has a shape to be contracted during when the insertion pieces are inserted into the insertion holes and to be expanded after penetrated through the insertion holes so that the insertion holes function as a lock receiving portion.

BRIEF DESCRIPTION OF THE DRAWINGS

FIG. 1A is a perspective view of an insole portion where a foot is in contact with the footwear. FIG. 1B is a perspective view of an upper portion having a portion crossing over instep of foot. FIG. 1B' is a perspective view showing a state just before attaching the upper portion shown in FIG. 1B. FIG. 1C is a perspective view of an outsole portion to which the upper portion shown in FIG. 1B' is attachable. FIG. 1D is a perspective view showing a state that the upper portion shown in FIG. 1B' is attached to the outsole portion shown in FIG. 1C. FIG. 1E is a perspective view showing a state that the insole portion shown in FIG. 1A is attached to FIG. 1D.

FIG. 2D' is a plan view partly seen through FIG. 2D.

FIGS. 3F1 to 3F4 and 3D1 to 3D4 are drawings for explaining a mechanism for attaching the upper portion to the outsole portion concerning the footwear of one embodiment of the present invention where a locking hole is formed on each of the insertion pieces. FIGS. 3F1 to 3F4 are plan views explaining a motion of attaching the insertion pieces of the upper portion shown in FIG. 1B to the insertion holes of the outsole portion shown in FIG. 1C. FIGS. 3D1 to 3D4 are cross-sectional views explaining a motion of attaching the insertion pieces of the upper portion shown in FIG. 1B to the insertion holes of the outsole portion shown in FIG. 1C. FIGS. 3F1 and 3D1 show a state before the insertion. FIGS. 3F2, 3D2, 3F3 and 3F4 show a state during the insertion. FIGS. 3F4 and 3D4 show a state after finishing the insertion.

FIGS. 4A to 4C, 4D1*a* to 4D3*e* and 4E are cross-sectional views of the footwear concerning the first to fourth embodiments of the present invention. FIGS. 4A to 4A and 4E are cross-sectional views of each portion in the first embodiment. FIG. 4A is a cross-sectional view of the insole portion, FIG. 4B is a cross-sectional view of the upper portion, and FIG. 4C is a cross-sectional view of the outsole portion before the insertion. FIG. 4E is a cross-sectional view after finishing the attachment. FIGS. 4D1*a* to 4D1*c* and 4D1*e* are cross-sectional views of each portion in the second embodiment. FIG. 4D1*a* is a cross-sectional view of the insole portion, 4D1*b* is a cross-sectional view of the upper portion and 4D1*c* is a cross-sectional view of the outsole portion before the insertion. FIG. 4D1*e* is a cross-sectional view after finishing the attachment. FIGS. 4D2*a* to 4D2*c* and 4D2*e* are cross-sectional views of each portion in the third embodiment. FIG. 4D2*a* is a cross-sectional view of the insole portion, 4D2*b* is a cross-sectional view of the upper portion and 4D2*c* is a cross-sectional view of the outsole portion before the insertion. FIG. 4D2*e* is a cross-sectional view after finishing the attachment. FIGS. 4D3*a* to 4D3*c* and 4D3*e* are cross-sectional view of each portion in the fourth embodiment. FIG. 4D3*a* is a cross-sectional view of a back lid, FIG. 4D3*b* is a cross-sectional view of the upper portion and FIG. 4D3*c* is a cross-sectional view of the outsole portion before the insertion. FIG. 4D3*e* is a cross-sectional view after finishing the attachment.

FIG. 5A is a perspective view of an insole portion where a foot is in contact with the footwear. FIG. 5B is a perspective view of an upper portion having a portion crossing over instep of foot. FIG. 5C is a perspective view of an outsole portion to which the upper portion shown in FIG. 5B is attachable. FIG. 5D is a perspective view showing a state that the upper portion shown in FIG. 5B is attached to the outsole portion shown in FIG. 5C. FIG. 5E is a perspective view showing a state that the insole portion shown in FIG. 5A is attached to FIG. 5D. FIG. 5A' is a cross-sectional view of FIG. 5A. FIG. 5B' is a cross-sectional view of FIG. 5B. FIG. 5C' is a cross-sectional view of FIG. 5C. FIG. 5E' is a cross-sectional view of FIG. 5E. FIG. 5D' is a plan view partly seen through FIG. 5D.

FIGS. 6A to 6E, 6A' to 6E' and 6E" are exploded views of a footwear of the sixth embodiment of the present invention. FIG. 6A is a perspective view of an insole portion where a foot is in contact with the footwear. FIG. 6B is a perspective view of an upper portion having a portion crossing over instep of foot. FIG. 6C is a perspective view of an outsole portion to which the upper portion shown in FIG. 6B is attachable. FIG. 6D is a perspective view showing a state that the upper portion shown in FIG. 6B is attached to the outsole portion shown in FIG. 6C. FIG. 6E is a perspective view showing a state that the insole portion shown in FIG. 6A is attached to FIG. 6D. FIG. 6A' is a cross-sectional view of FIG. 6A. FIG. 6B' is a cross-sectional view of FIG. 6B. FIG. 6C' is a cross-sectional view of FIG. 6C. FIG. 6E' is a cross-sectional view of FIG. 6E. FIG. 6E" is a cross-sectional view showing a portion between the insertion pieces shown in FIG. 6E. FIG. 6D' is a plan view partly seen through FIG. 6D except for the convex/concave locking shape.

FIGS. 7A to 7E, 7A' to 7E' and 7E" are exploded views of a footwear of the seventh embodiment of the present invention. FIG. 7A is a perspective view of an insole portion where a foot is in contact with the footwear. FIG. 7B is a perspective view of an upper portion having a portion crossing over instep of foot. FIG. 7C is a perspective view of an outsole portion to which the upper portion shown in FIG. 7B is attachable. FIG. 7D is a perspective view showing a state that the upper portion shown in FIG. 7B is attached to the outsole portion shown in FIG. 7C. FIG. 7E is a perspective view showing a state that the insole portion shown in FIG. 7A is attached to FIG. 7D. FIG. 7A' is a cross-sectional view of FIG. 7A. FIG. 7B' is a cross-sectional view of FIG. 7B. FIG. 7C' is a cross-sectional view of FIG. 7C. FIG. 7E' is a cross-sectional view of FIG. 7E. FIG. 7E" is a cross-sectional view showing a portion between the insertion pieces shown in FIG. 7E. FIG. 7D' is a plan view partly seen through FIG. 7D except for the convex/concave locking shape.

FIGS. 8F1 to 8F4 and 8D1 to 8D4 are drawings for explaining a mechanism for attaching the upper portion to the outsole portion concerning the footwear of the eighth embodiment of the present invention. FIGS. 8F1 to 8F4 are plan views explaining a motion of inserting the insertion pieces of the upper portion into the insertion holes of the outsole portion and then inserting into the lock receiving portion. FIGS. 8D1 to 8D4 are cross-sectional views explaining a motion of inserting the insertion pieces of the upper portion into the insertion holes of the outsole portion and then inserting into the lock receiving portion. FIGS. 8F1 and 8D1 show a state before the insertion. FIGS. 8F2, 8D2, 8F3 and 8F4 show a state during the insertion. FIGS. 8F4 and 8D4 show a state after finishing the insertion.

FIGS. 9G, 9G' and 9E are cross-sectional views of a footwear of the seventh embodiment of the present invention. FIGS. 9H, 9H' and 9E' are cross-sectional views of a footwear of the ninth embodiment of the present invention. FIGS. 9I, 9I' and 9E" are cross-sectional views of a footwear of the tenth embodiment of the present invention. FIGS. 9G, 9H and 9I are cross-sectional views cut at the rear side of a locking claw of each of the insertion pieces vertically to an insertion direction. FIGS. 9G', 9H' and 9I' are cross-sectional views cut at the locking claw of each of the insertion pieces vertically to the insertion direction. FIGS. 9E, 9E' and 9E" are cross-sectional views cut at the insertion pieces in the insertion direction.

FIGS. 10A to 10E are exploded views of the footwear of the eleventh embodiment. FIGS. 10D', 10E' and 10F1 to 10F3 are drawings explaining an attachment process of the upper portion. FIG. 10A is a perspective view of an insole portion where a foot is in contact with the footwear. FIG. 10B is a perspective view of an upper portion having a portion crossing over instep of foot. FIG. 10C is a perspective view of an outsole portion to which the upper portion shown in FIG. 10B is attachable. FIG. 10D is a perspective view showing a state that the upper portion shown in FIG. 10B is attached to the outsole portion shown in FIG. 10C. FIG. 10E is a perspective view showing a state that the insole portion shown in FIG. 10A is attached to FIG. 10D. FIGS. F1 to F3 are drawings explaining a process of inserting the insertion pieces into the insertion holes. FIG. 10E' is a cross-sectional view of FIG. 10E. FIG. 10D' is a plan view partly seen through FIG. 10D except for the convex/concave locking shape.

DETAILED DESCRIPTION OF THE INVENTION

Figure 1A:
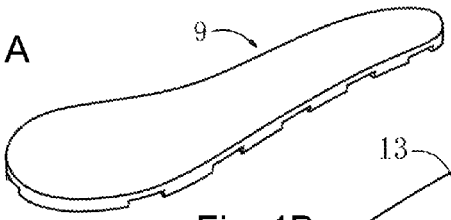
FIGS. 1A to 1E and 1B' are exploded views of a footwear of the first embodiment of the present invention.

The footwear of the first embodiment of the present invention is shown in FIGS. 1A to 1E, 1D', 2A to 2E and 2D'. An embodiment having the locking hole on each of the insertion pieces is partly explained in FIGS. 3F1 to 3F4 and 3D1 to 3D4. The cross-sectional views of the footwear of the first to fourth embodiments are shown in FIGS. 4A to 4C, 4D1*a* to 4D3*e* and 4E.

As shown in FIGS. 1A to 1E, 1D', 2A to 2E and 2D', a footwear 1 of the first embodiment is a sandal. An upper portion 5 is detachably attached to an outsole portion 3 and then a detachable mechanism 7 is covered with an insole portion 9. Thus, the upper portion 5 is replaceable.

Figure 1B:
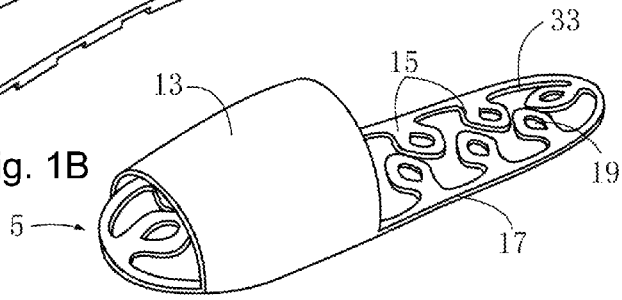
Figure 1B:
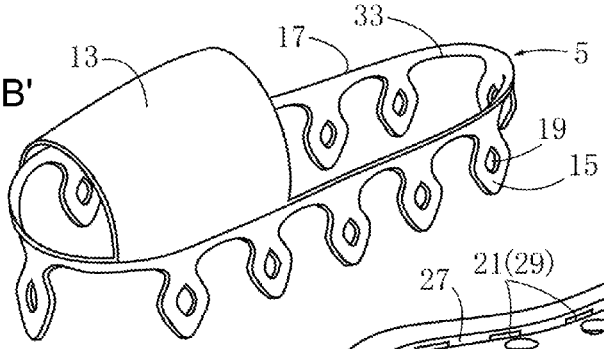
Figure 1C:
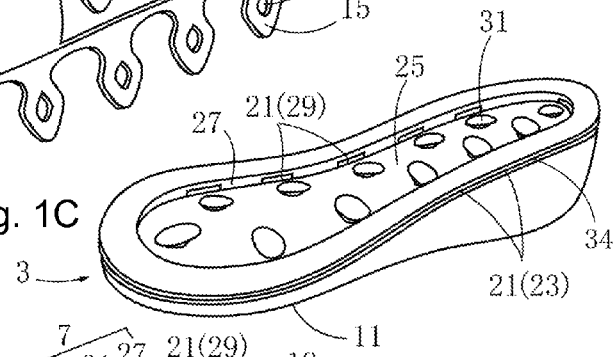
Figure 1D:
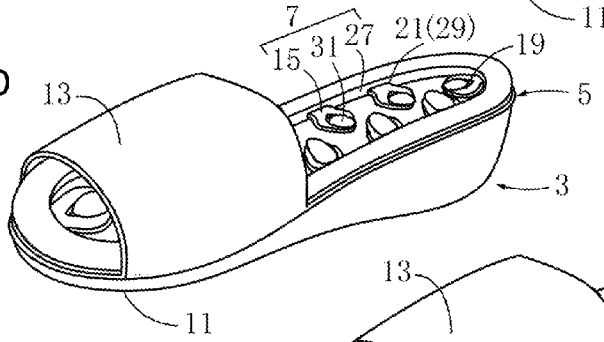

As shown in FIG. 1C, the outsole portion 3 forms a lower portion of the footwear 1, and the outsole portion 3 has a portion 11 to be in contact with the ground.

Figure 2A:
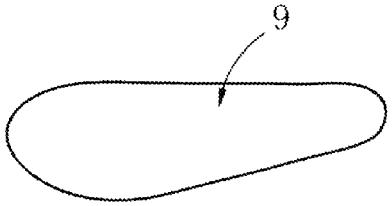
FIG. 2A is a plan view of FIG. 1A.
Figure 2B:
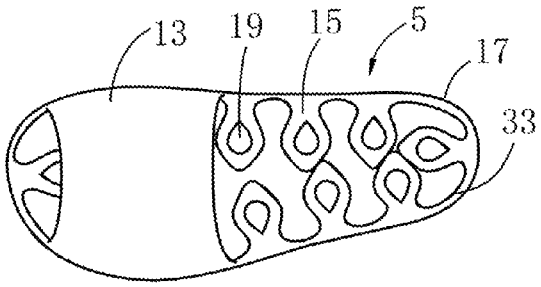
FIG. 2B is a plan view of FIG. 1B.

As shown in FIG. 1B and FIG. 2B, the upper portion 5 can be attached to and detached from the outsole portion 3, and the upper portion 5 has a portion 13 crossing over instep of foot. For attaching and detaching the upper portion 5, a plurality of insertion pieces 15 is formed on an entire periphery of the upper portion 5.

The insertion pieces 15 are integrally formed with the upper portion 5 by the same material having strength and elasticity. For example, synthetic resin is used. A locking hole 19 is formed at an approximately center of a tip of each of the insertion pieces 15. The insertion pieces 15 are formed on a periphery of the upper portion 5 and aligned along a frame portion 17. The insertion pieces 15 are arranged approximately horizontally toward an inner side of the upper portion 5. When inserting the insertion pieces 15, each of the insertion pieces 15 is temporarily directed downward and outward by elasticity as shown in FIG. 1B'.

As shown in FIG. 1C, a plurality of insertion holes 21 is formed on an upper edge of a side surface of the outsole portion 3 at an entire outer periphery of the outsole portion 3 so that the insertion pieces 15 are inserted into and penetrated through (completely inserted into) the insertion holes 21. The insertion holes 21 are located at a position of each of the insertion pieces 15 in a state that the upper portion 5 is attached. An inlet 23 is open at a surface of the insertion holes 21.

In order to ensure durability against the force applied from the insertion pieces 15 of the upper portion 5 to a peripheral part of the insertion holes of the outsole portion 3, the insertion holes 21 are preferably as small as possible. Accordingly, as shown in FIGS. 3AF1 to 3AF4 and other figures, a lateral dimension (vertical direction in the figures) of each of the insertion holes 21 is specified so that the insertion pieces 15 can be inserted into the insertion holes 21 after when the insertion pieces 15 become smaller in width by being contacted with the insertion holes 21 and pushed by the insertion holes 21 from both lateral ends of the insertion pieces 15 to shrink (reduce a diameter of) the locking hole 19. The upper portion is directly attached to the bottom of the recess located at the center of the outsole portion by locking the locking hole with the locking protrusions of the outsole portion. However, the insertion pieces of the upper portion are inserted into and penetrated through the insertion holes of the outsole portion. Thus, the upper portion is indirectly attached to a peripheral part of the outsole portion. Accordingly, the force applied to the upper portion is concentrated on the inlet of the insertion holes of the outsole portion. Because of this, the insertion holes are specified to be as small as possible, and a volume of the peripheral part to support the insertion holes is specified to be as large as possible to ensure durability against the force applied from the upper portion to the peripheral part of the inlet of the insertion holes of the outsole portion.

Figure 1E:
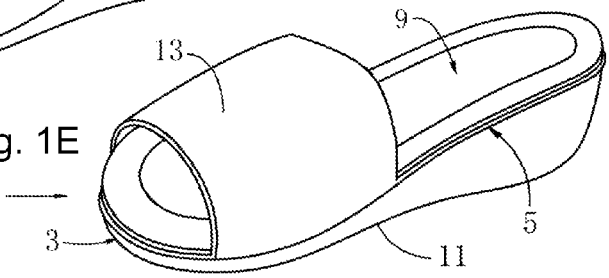
Figure 2C:
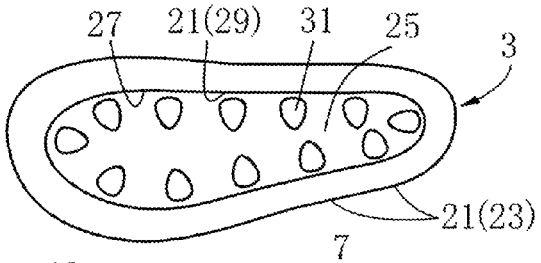
FIG. 2C is a plan view of FIG. 1C.

As shown in FIG. 1C, FIG. 2C and other figures, an outlet 29 of each of the insertion pieces 15 is open to an inner peripheral wall 27 of a recess 25 formed on the center of the upper surface of the outsole portion 3. Locking protrusions 31 are formed at a bottom of the recess 25 of the outsole portion 3 at a portion near the outlet 29. The locking protrusions 31 are arranged on a plurality of the bottom of the recess 25 at a position enabling to lock the locking hole 19 of each of the insertion pieces 15 in a state that the upper portion 5 is attached. Each of the locking protrusions 31 is formed in an approximately short cylindrical shape. Each of the locking protrusions 31 is inclined upward in a slope shape toward a front side in a direction of inserting the insertion pieces 15 so as not to prevent the insertion of the insertion pieces 15. On the other hand, a tip of each of the locking protrusions 31 is projected toward the insertion direction so that the insertion pieces 15 are not easily detached (FIGS. 3D1 to 3D4).

From the above, the direction of inserting the insertion pieces 15 into the insertion holes 21 is directed from an outer periphery of the outsole portion 3 to an inner side, different from the conventional one which is directed in a vertical direction. Each of the insertion pieces 15 is sharp-edged at a front end and tongue-shaped so that each of the insertion pieces 15 can be easily inserted into the narrow insertion holes 21 (FIGS. 1B, 1B', FIG. 2B, FIGS. 3F1 to 3F4). Each of the locking holes 19 is formed in a long shape longitudinally along a direction of inserting the insertion pieces 15 and is sharp-edged at a rear end so that the insertion pieces can be easily inserted into the insertion holes and easily pulled out of the insertion holes (FIGS. 1B, 1B', FIG. 2B). Each of the locking holes 19 is a so-called tear shape.

After the insertion pieces 15 are penetrated through the outlet 29 of the recess 25, the locking hole 19, which is temporarily deformed to be smaller in width in the insertion holes 21, is expanded by elasticity or a finger of a user. Then, the insertion pieces 15 are further expanded in the insertion direction, and the locking hole 19, which is enlarged in diameter, is fitted to the locking protrusions 31 from the tip of the locking protrusions 31, the tip being projected toward the insertion direction. Thus, the locking hole 19 formed on each of the insertion pieces 15 is locked. When the force is applied in a direction of pulling the insertion pieces 15 out of the insertion holes 21, the insertion pieces 15 are in contact with the insertion holes 21 again and pushed from both lateral ends. Thus, the force is applied in the direction of shrinking the locking hole 19. Because of this, the locking hole 19 strongly holds the locking protrusions 31, friction becomes larger, and the fitting becomes more tightly. Consequently, there is less possibility that the insertion pieces 15 are pulled out of the insertion holes 21. The insertion pieces 15 are restricted from being moved freely by the insertion holes 21. Even when one of the insertion pieces 15 is unlocked, the insertion pieces are not pulled out of the insertion holes unless neighboring insertion pieces are pulled out together. Namely, the attachment between the upper portion and the outsole portion is not released in the configuration of the present invention. Thus, the upper portion 5 is sufficiently prevented from pulling out of the outsole portion. Accordingly, safety of the footwear is considered enough, although an entire weight of a user is applied the footwear.

As the area to insert and lock the insertion pieces 15 becomes larger, the connecting area between the upper portion 5 and the outsole portion 3 can be larger and the upper portion 5 can be attached strongly to the outsole portion 3. Since the insertion pieces 15 are directed toward an inner side, not downward, the space is largely kept in an approximately horizontal direction. Thus, an area in a lateral dimension of the outsole portion can be smaller, and the footwear can be thinner.

Figure 2D:
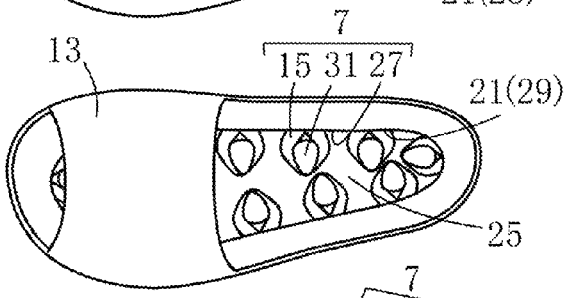
FIG. 2D is a plan view of FIG. 1D.
Figure 2D:
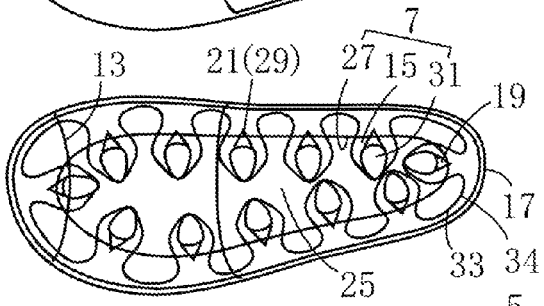

As show in FIGS. 1B, 1B', FIGS. 2B, 2D' and other figures, a portion connecting each of the insertion pieces 15 of the upper portion 5 is formed in a smooth curved line 33, and fitted into a groove 34 formed between each of the insertion holes of the outsole portion 3. Furthermore, each of the locking holes 19 is locked on the locking protrusions 31, and therefore both ends of the curved line 33 are pulled by the insertion pieces 15. Although the insertion pieces 15 are not formed on the curved line 33, the force in the center direction of the outsole portion 3 is also applied to the curved line 33. Thus, the upper portion 5 is more strongly attached to the outsole portion 3.

Figure 2E:
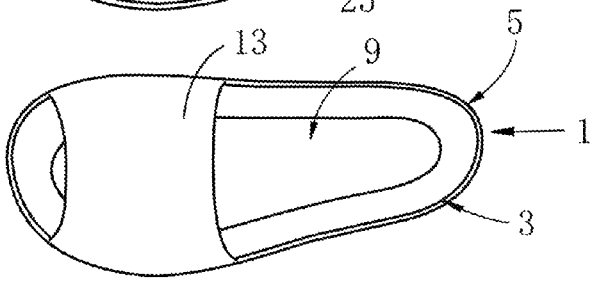
FIG. 2E is a plan view of FIG. 1E.

The detachable mechanism 7 formed by the insertion pieces 15 and the locking protrusions 31 is formed on the recess 25. As shown in FIG. 1E, FIG. 2E and FIG. 4E, the recess 25 is covered with the insole portion 9. A lower surface of the insole portion 9 has a shape to fill a gap of the locking protrusions 31. Accordingly, when the insole portion 9 is attached, there is less possibility that the locking hole 19 is removed from the locking protrusions 31.

By the above described configurations, the upper portion 5 can be replaced freely. If a wide variety of upper portions are prepared, the outsole portion 3 can be efficiently re-used and the footwear can be changed to have different functions. Consequently, a user can enjoy various fashions and can follow a trend while preventing the footwear from becoming old-fashioned. If the outsole portion 3, the upper portion 5 and the insole portion 9 are formed from the same reusable material, each portion can be recycled and the resource can be economically re-used.

FIGS. 5A to 5E and 5A' to 5E' show a footwear of the fifth embodiment of the present invention.

The footwear 1 of the fifth embodiment is a sandal. An upper portion 5 is detachably attached to an outsole portion 3 and covered with an insole portion 9. Thus, the upper portion 5 can be replaced.

Figure 5A:
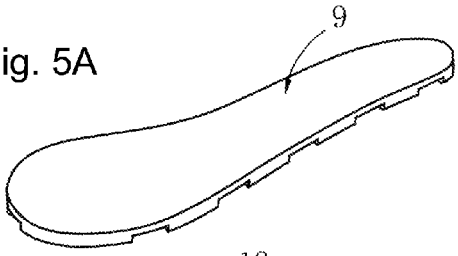
FIGS. 5A to 5E and 5A' to 5E' are exploded views of a footwear of the fifth embodiment of the present invention.
Figure 5A:
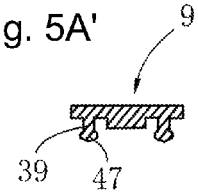
Figure 5B:
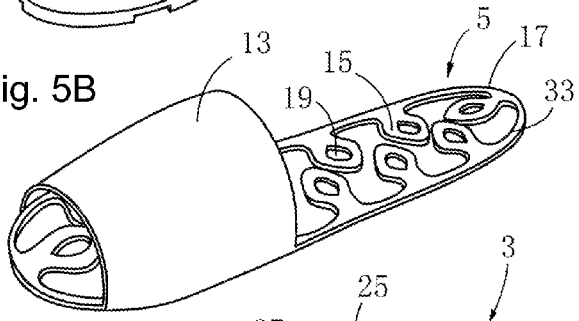
Figure 5B:
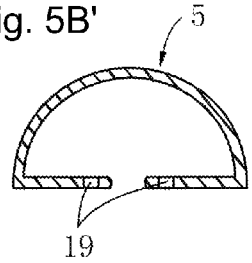
Figure 5C:
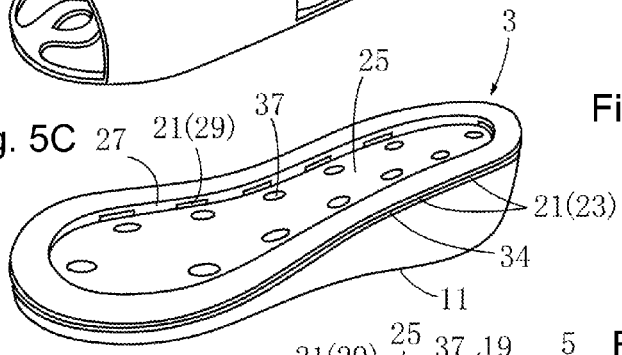
Figure 5C:
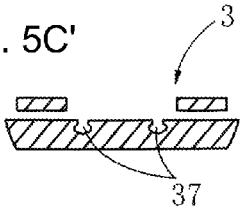
Figure 5D:
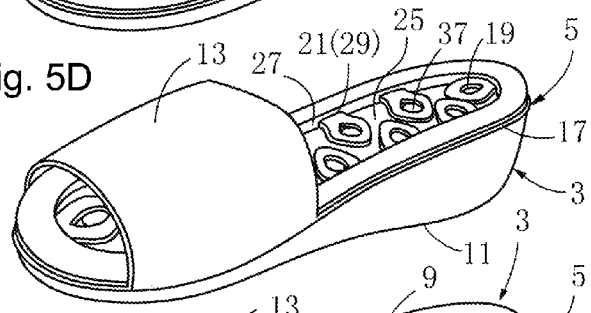
Figure 5E:
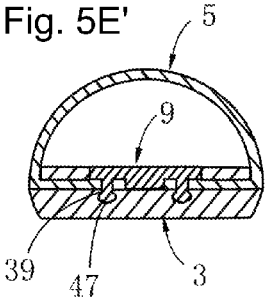
Figure 5E:
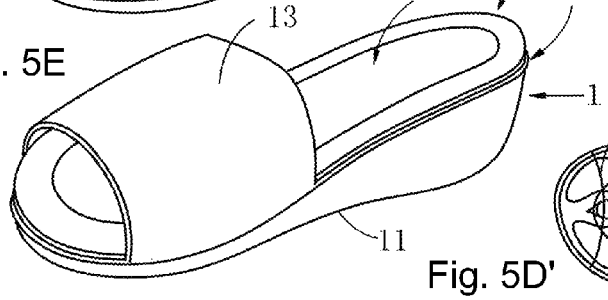
Figure 5D:
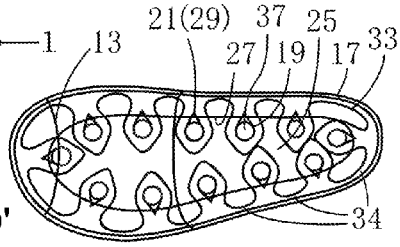

As shown in FIGS. 5C and 5C', the outsole portion 3 forms a lower part of the footwear 1, and the outsole portion 3 has a portion 11 to be in contact with the ground.

As shown in FIGS. 5B and 5B', the upper portion 5 can be attached to and detached from the outsole portion 3, and the upper portion 5 has a portion 13 crossing over instep of foot. For attaching and detaching the upper portion 5, a plurality of insertion pieces 15 is formed on an entire periphery of the upper portion 5.

The insertion pieces 15 are integrally formed with the upper portion 5 by the same material having strength and elasticity. For example, synthetic resin is used. The insertion pieces 15 are formed on a periphery of the upper portion 5 and aligned along a frame portion 17. The insertion pieces 15 are arranged approximately horizontally toward an inner side of the upper portion 5.

A plurality of insertion holes 21 is formed on the outsole portion 3 at a position of each of the insertion pieces 15 in a state that the upper portion 5 is attached so that the insertion pieces 15 are inserted into and penetrated through (completely inserted into) the insertion holes 21. The insertion holes 21 are formed on an upper edge of a side surface of the outsole portion 3 at an entire outer periphery of the outsole portion 3. An inlet 23 is open at a surface of the insertion holes 21.

A recess 25 having a shallow depth is formed on the center of the upper surface of the outsole portion 3. The recess 25 has a shape and an area to be completely covered by the insole portion 9 when the insole portion 9 is fitted with the recess 25. As shown in FIGS. 5C, 5C' and other figures, an outlet 29 of each of the insertion holes 21 is open to an inner peripheral wall 27 of the recess 25. Because of this, the direction of inserting the insertion pieces 15 into the insertion holes 21 is directed from an outer periphery of the upper portion 5 to an inner side.

A locking hole 19 is formed at an approximately center of a tip of each of the insertion pieces 15. The locking hole 19 is formed in a long shape longitudinally along a direction of inserting the insertion pieces 15 and is sharp-edged at a rear end. The locking hole 19 is a so-called tear shape. A lateral dimension of each of the insertion holes 21 is specified so that the insertion pieces 15 can be inserted into the insertion holes 21 after when the insertion pieces 15 become smaller in width by being contacted with the insertion holes 21 and pushed by the insertion holes 21 from both lateral ends of the insertion pieces 15 to shrink the locking hole 19.

The configurations described above are same as the first embodiment. In the fifth embodiment, other than the configurations above, a fitting hole 37 is formed at a bottom of the recess 25 at a position to be overlapped with the locking hole 19 in a state that the upper portion 5 is attached to the outsole portion 3. Furthermore, fitting protrusions 39 are formed on the insole portion 9 at a position enabling to pass through the locking holes 19 and to fit with the fitting holes 37.

Namely, after the insertion pieces 15 are inserted into the insertion holes 21, the fitting protrusions 39 formed on the insole portion 9 are inserted into the locking holes 19 and fitted with the fitting holes 37. Thus, the locking holes 19 are attached to the outsole portion 3 via the fitting protrusions 39. Since a locking shape is formed on a tip of the fitting protrusions 39, the fitting protrusions 39 are tightly attached to the outsole portion 3 and hardly removed from the locking hole 19. In other words, the insertion pieces 15 is hardly pulled out from the insertion holes 21, and the upper portion 5 is sufficiently prevented from being pulled out.

Functions and effects of the fifth embodiment are same as the first embodiment except for the method of attaching the insertion pieces.

FIGS. 6A to 6E, 6A' to 6E' and 6E" show a footwear of the sixth embodiment of the present invention. The explanations of the configurations in common with the first embodiment are omitted since the configurations are written in the paragraph [0040]. Refer to the paragraph [0040] for the names and the explanations of the common configurations.

In the sixth embodiment, different from other embodiments, after the insertion pieces 15 are inserted into the insertion holes 21 and reached to the recess 25 formed at the center, locking claws 41 are locked by lock receiving portions 45 arranged at the bottom of the recess 25. A shape of the lock receiving portions 45 is inclined upward in a slope shape toward a front side in the insertion direction. Because of this, the lock receiving portions 45 do not interfere with the insertion of the insertion pieces 15, and the insertion pieces 15 can be smoothly attached and detached. A fit-in port of the lock receiving portions 45 is narrower than a dimension of the corresponding part of the locking claws 41 and a tip of the lock receiving portions 45 is projected (FIG. 6E") toward the insertion direction. Because of this, the locking claws 41 are prevented from being removed from the lock receiving portions 45.

Accordingly, same as the first embodiment, the insertion pieces are hardly pulled out of the insertion holes by the above described locking mechanism. Thus, the upper portion can be sufficiently prevented from being pulled out and the footwear can be thinner. Namely, functions and effects of the sixth embodiment are same as the first embodiment except for the method of attaching the insertion pieces.

FIGS. 7A to 7E, 7A' to 7E' and 7E" show a footwear of the seventh embodiment. The explanations of the configurations in common with the first embodiment are omitted since the configurations are written in the paragraph [0040]. Refer to the paragraph for the names and the explanations of the common configurations.

In the seventh embodiment, different from other embodiments, after the insertion pieces 15 are inserted into the insertion holes 21 and reached to the recess 25 located at the center, locking constrictions 43 are locked by being fitted with the lock receiving portions 45 formed at the bottom of the recess 25. The lock receiving portions 45 and the tip of the insertion pieces 15 have protrusions and recesses corresponding to each other. A shape of the lock receiving portions 45 is inclined upward (FIG. 7E") in a slope shape toward a front side in the insertion direction. Because of this, the lock receiving portions 45 do not interfere with the insertion of the insertion pieces 15, and the insertion pieces 15 can be smoothly attached and detached. A fit-in port of the lock receiving portions 45 is narrower than a dimension of the corresponding part of the locking claws 41. Because of this, the locking constrictions 43 are prevented from being removed from the lock receiving portions 45.

Accordingly, same as the first embodiment, the insertion pieces 15 are hardly pulled out of the insertion holes 21 by the above described locking mechanism. Thus, the upper portion 5 can be sufficiently prevented from being pulled out and the footwear can be thinner.

Namely, functions and effects of the seventh embodiment are same as the first embodiment except for the method of attaching the insertion pieces.

FIGS. 9H, 9H' and 9E' show partial cross-sectional views of the insertion pieces of the footwear of the ninth embodiment.

Functions, effects and configurations of the footwear of the present embodiment are same as the first embodiment except for the method of locking the insertion pieces 15 on the outsole portion 3. The explanations are omitted except for the different part.

In the present embodiment, the lock receiving portions 45 are formed on the insole portion 9. The lock receiving portions 45 and the tip of the insertion pieces 15 have protrusions and recesses corresponding to each other. When the insole portion 9 is attached to the outsole portion 3, the locking claws 41 formed on each of the insertion pieces 15 are locked on the lock receiving portions 45. In this case, since the insertion pieces 15 are locked by attaching the insole portion 9, the insole portion 9 should be strongly attached to the outsole portion 3. A locking shape 47 having protrusions and recesses is formed on the outsole portion 3 and the insole portion 9 at a portion between each of the neighboring insertion pieces 15 so as to attach the insole portion 9 strongly.

From the above, same as the first embodiment, the insertion pieces are hardly pulled out of the insertion holes. Thus, the upper portion 5 can be sufficiently prevented from being pulled out and the footwear can be thinner.

FIGS. 9I, 9I' and 9E" show a partial cross-sectional view of the insertion pieces of the footwear of the tenth embodiment.

Functions, effects and configurations of the footwear of the present embodiment are same as the first embodiment except for the method of locking the insertion pieces 15 on the outsole portion 3. The explanations are omitted except for the different part.

In the present embodiment, the lock receiving portions 45 are formed by attaching the insole portion 9 on the outsole portion 3. The lock receiving portions 45 and the tip of the insertion pieces 15 have protrusions and recesses corresponding to each other. When the insole portion 9 is attached to the outsole portion 3, the locking claws 41 formed on each of the insertion pieces 15 are locked on the lock receiving portions 45 formed by both the insole portion 9 and the outsole portion 3. In this case, since the insertion pieces 15 are locked by attaching the insole portion 9, the insole portion 9 should be strongly attached to the outsole portion 3. A locking shape 47 having protrusions and recesses is formed on the outsole portion 3 and the insole portion 9 at a portion between each of the neighboring insertion pieces 15 so as to attach the insole portion 9 strongly.

From the above, same as the first embodiment, the insertion pieces are hardly pulled out of the insertion holes. Thus, the upper portion can be sufficiently prevented from being pulled out and the footwear can be thinner.

FIGS. 10A to 10E, 10D', 10E' and 10F1 to 10F3 show a footwear of the eleventh embodiment. The names and the explanations are same as the paragraph [0040] except that B' and C' are not provided on the figures.

In the eleventh embodiment, different from other embodiments, a mechanism of attaching the insertion pieces 15 to the outsole portion 3 is not formed. For example, the mechanism is the fitting protrusions 31 in the first embodiment. In the present embodiment, as shown the insertion process in FIGS. 10F1, 10F2 and 10F3, the insertion holes 21 themselves function as the lock receiving portion. The locking claws 41 formed on each of the insertion pieces 15 are locked at the same time when the insertion pieces 15 are inserted into the recess 25. Accordingly, same as the first second embodiment, the insertion pieces are hardly pulled out of the insertion holes by the above described locking mechanism. Thus, the upper portion can be sufficiently prevented from being pulled out and the footwear can be thinner. Namely, functions and effects are same as the first embodiment except for the method of attaching the insertion pieces.

Other Embodiments (1) In the perspective view of the above described embodiments, the inlets 23 of the insertion holes 21 are open to a side surface of the periphery of the outsole portion 3 and the insertion holes 21 are approximately horizontal entirely from the inlet to the outlet. As shown in FIGS. 4D1*a*, 4D1*b*, 4D1*c* and 4D1*e* as the second embodiment, the inlets 23 can be open to an upper surface of the periphery of the outsole portion 3 and the insertion holes 21 can be formed in a combination of an approximately L-shape and an approximately horizontal shape.

(2) As shown in FIGS. 4D2*a*, 4D2*b*, 4D2*c* and 4D2*e* as the third embodiment, the inlet 23 can be open to a periphery of a corner portion crossing the side surface and the upper surface, and the insertion holes 21 can be formed in a combination of an approximately L-shape and an approximately horizontal shape.

(3) In the above described embodiments, the insole portion 9 should be removed when attaching and detaching the upper portion 5 to expose the detachable mechanism 7. However, in another embodiment, the detachable mechanism 7 is always exposed from the bottom surface (reverse side of the upper surface) of the outsole portion 3 and the locking protrusions 31 are directed in the opposite direction (downward). The operations of the insertion or the locking can be done form the bottom surface (reverse side) of the outsole portion 3. Accordingly, the upper portion 5 can be attached and detached without removing the insole portion 9.

(4) In addition to change the direction of the locking protrusions 31 downward as described in (3), the detachable mechanism 7 exposed on the bottom surface (reverse side) of the outsole portion 3 can be covered with a back lid 35. When attaching or detaching the upper portion 5, the back lid 35 is removed to expose the detachable mechanism 7. In order to prevent the back lid 35 from falling downward, the back lid 35 and the bottom surface (reverse side) of the outsole portion 3 are locked by the locking shape 47 having protrusions and recesses.

(5) In the above described case, as shown in FIGS. 4D3*a*, 4D3*b*, 4D3*c* and 4D3*e* as the fourth embodiment, the upper portion 5 can be formed integrally with the insole portion 9. When the insole portion 9 is integrally formed and not detachable from the upper portion 5, waterproofing performance is improved. Also in this case, in order to prevent the back lid 35 from falling downward, the back lid 35 and the bottom surface (reverse side) of the outsole portion 3 are locked by the locking shape 47 having protrusions and recesses.

(6) In the above described embodiments, the locking hole 19 is sharp-edged at a rear end. In another embodiment, the locking hole 19 can be sharp-edged at a front end. In addition, both the front end and the rear end can be sharp-edged. Because of this, the insertion pieces 15 can be more easily inserted.

(7) As shown in FIG. 6D', FIG. 7D', FIGS. 9G, 9G', 9G" and FIG. 10D', protrusions having a locking shape can be formed on gap parts to prevent the insole portion 9 from removing, in addition to the protrusions to prevent the back lid 35 from falling. Furthermore, the insole portion 9 can be locked by forming the locking shape 47 having protrusions and recesses corresponding to the recess 25 of the outsole portion on the insole portion 9 or whole the back lid 35.

(8) In the above described embodiments, each of the lock receiving portions 45 is integrally formed connecting the edges of neighboring locking claws 41 or neighboring locking constrictions 43. However, the lock receiving portions 45 can be formed by two protrusions. Also in such a case, if the protrusions are inclined upward in a slope shape toward a front side in the insertion direction, the protrusions do not interfere with the insertion of the insertion pieces 15 and the insertion pieces 15 can be smoothly attached and detached. If the fit-in port of the lock receiving portions 45 is narrower than a dimension of the corresponding part of the locking claws 41 or the locking constrictions 43, or if the tip of the lock receiving portions 45 is projected toward the insertion direction, the locking claws 41 or the locking constrictions 43 are prevented from being removed from the lock receiving portions 45.

(9) In the above described embodiments, the tip of the insertion pieces is shown as an arrow shape in case of the locking claws, and as a circular shape in case of the locking constrictions. However, the shape can be any shape as long as the lock receiving portions 45 have a shape capable of locking and the lock receiving portions 45 has a protrusion such as a claw or a constriction. For example, a particular shape such as a star-shape and a heart-shape or an asymmetry shape can be used for locking.

(10) In the locking claws 41 or the locking constrictions 43 of the above described embodiments, the claw or the constriction is formed in left and right directions of the insertion piece. However, the claw or the constriction can be formed only in one of the left and right directions, both upper and lower direction, one of the upper and lower direction, or all directions.

Also in such a case, if the protrusions are inclined upward in a slope shape toward a front side in the insertion direction, the protrusions do not interfere with the insertion of the insertion pieces and the insertion pieces can be smoothly attached and detached. If the fit-in port of the lock receiving portions 45 is narrower than a dimension of the corresponding part of the locking claws 41 or the locking constrictions 43, or if the tip of the lock receiving portions 45 is projected toward the insertion direction, the locking claws 41 or the locking constrictions 43 are prevented from being removed from the lock receiving portions 45.

(11) As for the locking claws 41 or the locking constrictions 43, in addition to the above described mechanism of preventing them from being removed from the lock receiving portions 45, a protrusions for hooking a finger can be formed on the insertion pieces 15 or a recess for inserting a finger can be formed on the neighboring part of the lock receiving portions 45 having a recessed shape as shown in FIG. 7C so that the locking claws 41 or the locking constrictions 43 can be removed easily.

(12) As for the lock receiving portions 45, as shown in the plan views shown in FIGS. 8F1 to 8F4 and the cross-sectional views shown in FIGS. 8D1 to 8D4, the insertion pieces 15 can be inserted into the lock receiving portions 45 formed in a loop shape after the insertion pieces 15 are penetrated through the recess 25 to lock the insertion pieces 15, same as the locking claws 41 of the tenth embodiment.

(13) In the above described embodiments, as for the upper portion 5 and the outsole portion 3, the insertion pieces 15 and the insertion holes 21 are formed on an entire periphery. However, when the footwear (e.g. sandal) has a shape crossing over foot only at a particular portion and the upper portion is replaced only at the particular portion, the insertion pieces 15 and the insertion holes 21 can be formed only at the particular portion.

(14) The footwear 1 of the above described embodiments is a sandal. As another embodiment, the present invention can be applied to other kinds of footwear 1, such as shoes or boots, formed by the outsole portion 3 and the upper portion 5.

(15) In the above described embodiments, the insertion pieces 15 are made of the same material with the upper portion 5 and integrally formed with the upper portion 5. In another embodiment, the insertion pieces 15 can be made of a different material, of course. For example, the insertion pieces 15 can be made of synthetic resin, while the upper portion 5 is made of leather. In addition, the insertion pieces 15 and the upper portion 5 can be integrated by connecting with each other.

Note that, this invention is not limited to the above-mentioned embodiments. Although it is to those skilled in the art, the following are disclosed as the one embodiment of this invention.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

While the invention has been particularly shown and described with respect to preferred embodiments thereof, it should be understood by those skilled in the art that the foregoing and other changes in form and detail may be made therein without departing from the sprit and scope of the invention as defined in the appended claims.

What is claimed is:

1. A footwear, comprising:

an outsole portion having a portion to be in contact with the ground; and an upper portion having a portion crossing over instep of foot, the upper portion being attachable to and detachable from the outsole portion; wherein a plurality of insertion pieces made of a material having elasticity is formed on a periphery of the upper portion, a recess is formed on a center of an upper surface of the outsole portion, insertion holes are formed on the outsole portion, the insertion holes being directed from an outer periphery of the outsole portion to the recess located at the center, a groove is formed between each of the insertion holes so that a joint portion connecting each of the insertion pieces is fitted into the groove when the upper portion is attached to the outsole portion, the groove being directed from the outer periphery to an inner side of the outsole portion, and the upper portion is attachable to the outsole portion by inserting the insertion pieces into the insertion holes in a direction toward the recess located at the center.

2. The footwear according to claim 1, wherein a locking hole is formed on each of the insertion pieces, and locking protrusions are formed at a bottom of the recess formed on the center of the upper surface of the outsole portion, the locking protrusions being located at a position enabling to lock the locking hole in a state that each of the insertion pieces is penetrated through the insertion holes.

3. The footwear according to claim 1, further comprising an insole portion attached to the upper surface of the outsole portion, wherein a locking hole is formed on each of the insertion pieces, a fitting hole is formed at a bottom of the recess formed on the center of the upper surface of the outsole portion, the fitting hole being located at a position to be overlapped with the locking hole in a state that each of the insertion pieces is penetrated through the insertion holes, and a fitting protrusion is formed on the insole portion, the fitting portion being located at a position enabling to pass through the locking hole and to fit with the fitting hole in a state that the upper portion and the insole portion are attached to the outsole portion.

4. The footwear according to claim 1, wherein a locking claw or a locking constriction is formed on a tip of each of the insertion pieces, and a lock receiving portion is formed at a bottom of the recess formed on the center of the upper surface of the outsole portion, the lock receiving portion being located at a position enabling to lock the locking claw or the locking constriction in a state that each of the insertion pieces is penetrated through the insertion holes.

5. The footwear according to claim 1, further comprising an insole portion attached to the upper surface of the outsole portion, wherein a locking claw or a locking constriction is formed on a tip of each of the insertion pieces, and a lock receiving portion is formed on the insole portion, the lock receiving portion being located at a position enabling to lock the locking claw or the locking constriction in a state that the upper portion and the insole portion are attached to the outsole portion.

6. The footwear according to claim 1, wherein a locking claw is formed on a tip of each of the insertion pieces, and each of the insertion pieces has a shape to be contracted during when the insertion pieces are inserted into the insertion holes and to be expanded after penetrated through the insertion holes so that the insertion holes function as a lock receiving portion.

7. The footwear according to claim 2, wherein a dimension of each of the insertion holes is specified so that the insertion pieces can be inserted into the insertion holes after when the insertion pieces becomes smaller in width by being in contacted with the insertion holes and pushed by the insertion holes from both lateral ends of the insertion pieces to shrink the locking hole.

8. The footwear according to claim 2, wherein each of the insertion pieces is sharp-edged at a front end and tongue-shaped, and the locking hole is formed in a long shape longitudinally along a direction of inserting the insertion pieces.

9. The footwear according to claim 2, wherein each of the insertion pieces is sharp-edged at a front end and tongue-shaped, and the locking hole is sharp-edged at a front end and/or a rear end in a direction of inserting the insertion pieces.

10. The footwear according to claim 2, wherein each of the locking protrusions or the lock receiving portion is inclined upward in a slope shape toward a front side in a direction of inserting the insertion pieces.

11. The footwear according to claim 3, wherein the fitting protrusion and the fitting hole are formed in a locking shape.

12. A footwear, comprising:

an outsole portion having a portion to be in contact with the ground; and an upper portion having a portion crossing over instep of foot, the upper portion being attachable to and detachable from the outsole portion; wherein a plurality of insertion pieces made of a material having elasticity is formed on a periphery of the upper portion, a recess is formed on a center of a lower surface of the outsole portion, insertion holes are formed on the outsole portion, the insertion holes being directed from an outer periphery of the outsole portion to the recess located at the center, a groove is formed between each of the insertion holes so that a joint portion connecting each of the insertion pieces is fitted into the groove when the upper portion is attached to the outsole portion, the groove being directed from the outer periphery to an inner side of the outsole portion, and the upper portion is attachable to the outsole portion by inserting the insertion pieces into the insertion holes in a direction toward the recess located at the center.

* * * * *